US010624439B2

(12) United States Patent
Edwards

(10) Patent No.: US 10,624,439 B2
(45) Date of Patent: Apr. 21, 2020

(54) WRIST WORN CRAYON HOLDER

(71) Applicant: Jacob Edwards, Willoughby, OH (US)

(72) Inventor: Jacob Edwards, Willoughby, OH (US)

( * ) Notice: Subject to any disclaimer, the term of this patent is extended or adjusted under 35 U.S.C. 154(b) by 0 days.

(21) Appl. No.: 15/797,288

(22) Filed: Oct. 30, 2017

(65) Prior Publication Data

US 2018/0116382 A1 May 3, 2018

Related U.S. Application Data

(60) Provisional application No. 62/415,687, filed on Nov. 1, 2016.

(51) Int. Cl.

| | |
|---|---|
| ***A45F 5/00*** | (2006.01) |
| ***B43K 23/016*** | (2006.01) |
| ***A45C 11/34*** | (2006.01) |
| ***B43L 15/00*** | (2006.01) |

(52) U.S. Cl.

CPC ..... *A45F 5/00* (2013.01); *A45C 11/34* (2013.01); *B43K 23/016* (2013.01); *B43L 15/00* (2013.01); *A45F 2005/008* (2013.01)

(58) Field of Classification Search

CPC .. A45F 5/00; A45F 2005/008; A45F 2200/05; A45F 2200/0575; A45C 11/34; B43K 23/016; B43K 23/001; B43L 15/00

USPC ..... 224/219

See application file for complete search history.

(56) References Cited

U.S. PATENT DOCUMENTS

| | | | | | |
|---|---|---|---|---|---|
| 1,827,607 | A | * | 10/1931 | Pfaffinger | D05B 91/12 224/219 |
| 2,926,631 | A | * | 3/1960 | Palmer | B43K 23/001 224/162 |
| 3,273,766 | A | * | 9/1966 | Cosentino | A44C 5/0046 224/197 |
| D256,292 | S | * | 8/1980 | Cox | 224/219 |
| 4,830,246 | A | * | 5/1989 | Ryan | A01L 11/00 168/45 |
| 5,437,399 | A | * | 8/1995 | Levitt | A45F 5/00 224/219 |
| D720,400 | S | * | 12/2014 | Featherston | A44C 5/0046 D19/85 |
| 2013/0020359 | A1 | * | 1/2013 | Green | A45F 5/00 224/222 |
| 2014/0263496 | A1 | * | 9/2014 | Zimmerman | B43K 23/016 224/222 |

* cited by examiner

*Primary Examiner* — Corey N Skurdal

(74) *Attorney, Agent, or Firm* — Fay Sharpe LLP

(57) ABSTRACT

Disclosed is a device that holds writing utensils, particularly crayons, which can be worn on the wrist by the user. The device has a rigid housing with a plurality of slots where crayons can be stored, two adjustable wings that wrap around the user's wrist, and a connector structure which joins the housing structure and the wings together.

19 Claims, 4 Drawing Sheets

WRIST WORN CRAYON HOLDER

CROSS-REFERENCE TO RELATED APPLICATIONS

This application claims priority to U.S. Provisional Patent Application Ser. No. 62/415,687, filed Nov. 1, 2016, which is fully incorporated by reference herein.

BACKGROUND

The present disclosure relates to a crayon holder that may be worn on the user's wrist. This provides quick and convenient access to the crayons, as well as a convenient means for transporting them.

A common problem faced by children and adults is misplacing their writing utensil(s) while drawing, working, doodling, writing, or coloring. This can occur, for example, when using multiple crayons to color a picture. The additional utensils can roll away, become buried underneath papers, or be "borrowed" by another user.

One solution to this problem is simply putting the crayons back into their packaging. However, the packaging can also become buried under papers. Crayon packaging, and similar packaging, is also typically constructed of a thin cardboard that tears and breaks after a short amount of time. It would be desirable to provide a product that provides a convenient and durable holder for writing utensils such as crayons.

BRIEF DESCRIPTION

The present application discloses, in various exemplary embodiments, a device that holds crayons and can be worn on a user's wrist. The wrist worn crayon holder consists of two distinct parts: a rigid housing structure, and a set of wings for holding the crayon holder on the arm/wrist of the user. The entire apparatus can be constructed of a plastic material.

Disclosed in various embodiments are devices for holding writing instruments, comprising: a rigid housing enclosing a plurality of slots; and two curved wings extending from the bottom of the rigid housing that surround a wrist to hold the device in place.

Also disclosed herein are devices for holding writing instruments, comprising: a rigid housing having a front wall and a back wall, a top wall, a bottom wall, and two side walls, and a plurality of enclosed slots extending completely through the housing from the front wall to the back wall; and two curved wings extending from the bottom wall of the rigid housing that curve towards each other for surrounding the arm of a user.

The rigid housing may be curved to conform to the arm of a user. The rigid housing may have two side walls that have a rectangular shape.

In particular embodiments, the enclosed slots are cylindrical and are all of substantially the same length. There may be a total of seven slots.

It is contemplated that the two curved wings do not contact each other at their distal ends. They simply surround the user's arm/wrist.

A top length of the rigid housing may be substantially the same length as a bottom length of the rigid housing.

It is contemplated that the device does not include any chain for joining the device to a writing utensil/crayon. Similarly, the device is not intended to store the writing utensils/crayons within a case, and so the rigid housing has no lid.

The device may have a length of less than 3.5 inches.

In particular embodiments, each curved wing has a proximal end adjoining the bottom wall of the rigid housing; a distal end; and a flexible bearing between the proximal end and the distal end. The flexible bearing is essentially thinner than the rest of the curved wing, so that some flexure is possible.

In particular embodiments, the plurality of slots are defined by the top wall and the bottom wall of the rigid housing. Put another way, there are no side walls between each slot. Of course, in particular embodiments, such side walls are present.

These and other non-limiting characteristics of the disclosure are more particularly disclosed below.

BRIEF DESCRIPTION OF THE DRAWINGS

The following is a brief description of the drawings, which are presented for the purposes of illustrating the exemplary embodiments disclosed herein and not for the purposes of limiting the same.

DETAILED DESCRIPTION

Figure 1:
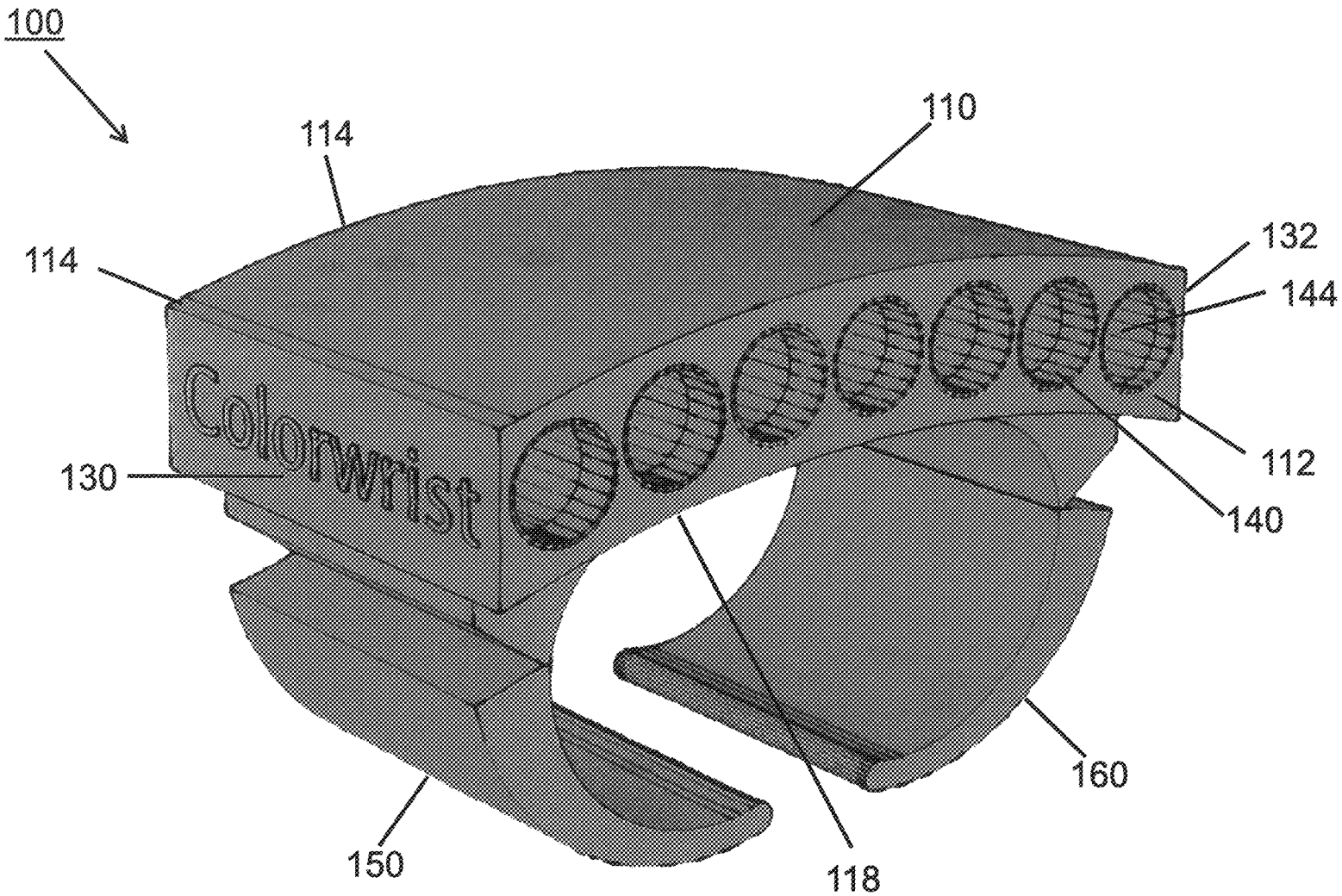
FIG. 1 is a front perspective view of an exemplary embodiment of a wrist worn crayon holder of the present disclosure.

A more complete understanding of the components and apparatus disclosed herein can be obtained by reference to the accompanying drawings. These figures are merely schematic representations based on convenience and the ease of demonstrating the present disclosure, and are, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function. The singular forms "a," "an," and "the" include plural referents unless the context clearly dictates otherwise.

As used in the specification, various devices and parts may be described as "comprising" other components. The terms "comprise(s)," "include(s)," "having," "has," "can," "contain(s)," and variants thereof, as used herein, are intended to be open-ended transitional phrases, terms, or words that do not preclude the possibility of additional components. However, such description should be construed as also describing the devices and parts as "consisting of" and "consisting essentially of" the enumerated components, and excluding other components.

Numerical values should be understood to include numerical values which are the same when reduced to the same number of significant figures and numerical values which differ from the stated value by less than the experimental error of the conventional measurement technique used to determine the value.

As used herein, approximating language may be applied to modify any quantitative representation that may vary without resulting in a change in the basic function to which it is related. Accordingly, a value modified by a term or terms, such as "about" and "substantially," may not be limited to the precise value specified, in some cases. The modifier "about" should also be considered as disclosing the range defined by the absolute values of the two endpoints. For example, the expression "from about 2 to about 4" also discloses the range "from 2 to 4."

The present disclosure relates to a holder for writing utensils, such as crayons, that can be worn around the arm or wrist of the user. The holder provides convenient access to the crayons for the user. Generally, the holder is made up of (1) a rigid housing, in which the crayons are held, and (2) a pair of curved wings that surround the arm/wrist of the user for fixing the holder in place.

Figure 2:
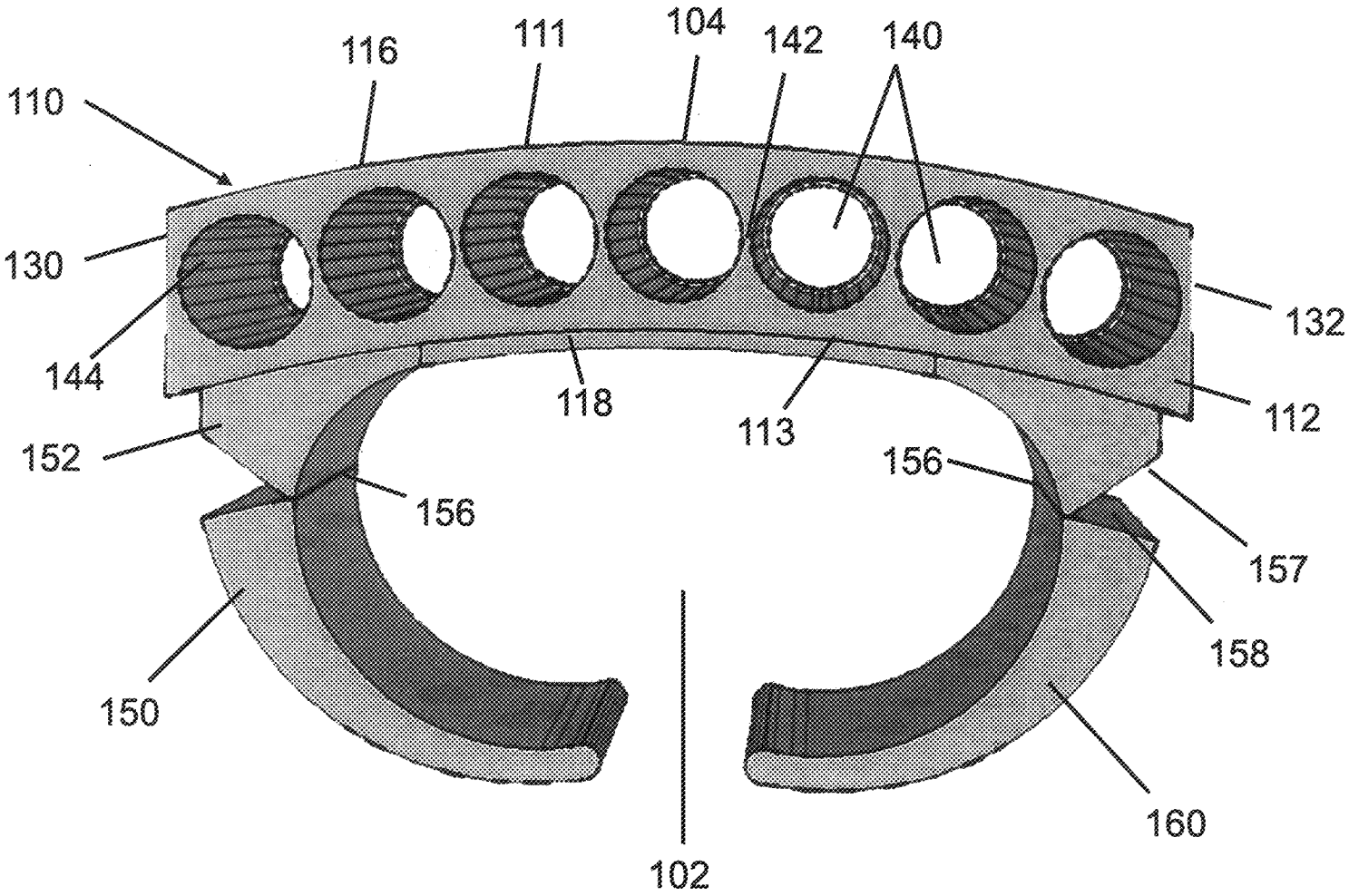
FIG. 2 is a front view of the wrist worn crayon holder of FIG. 1.
Figures 3, 4:
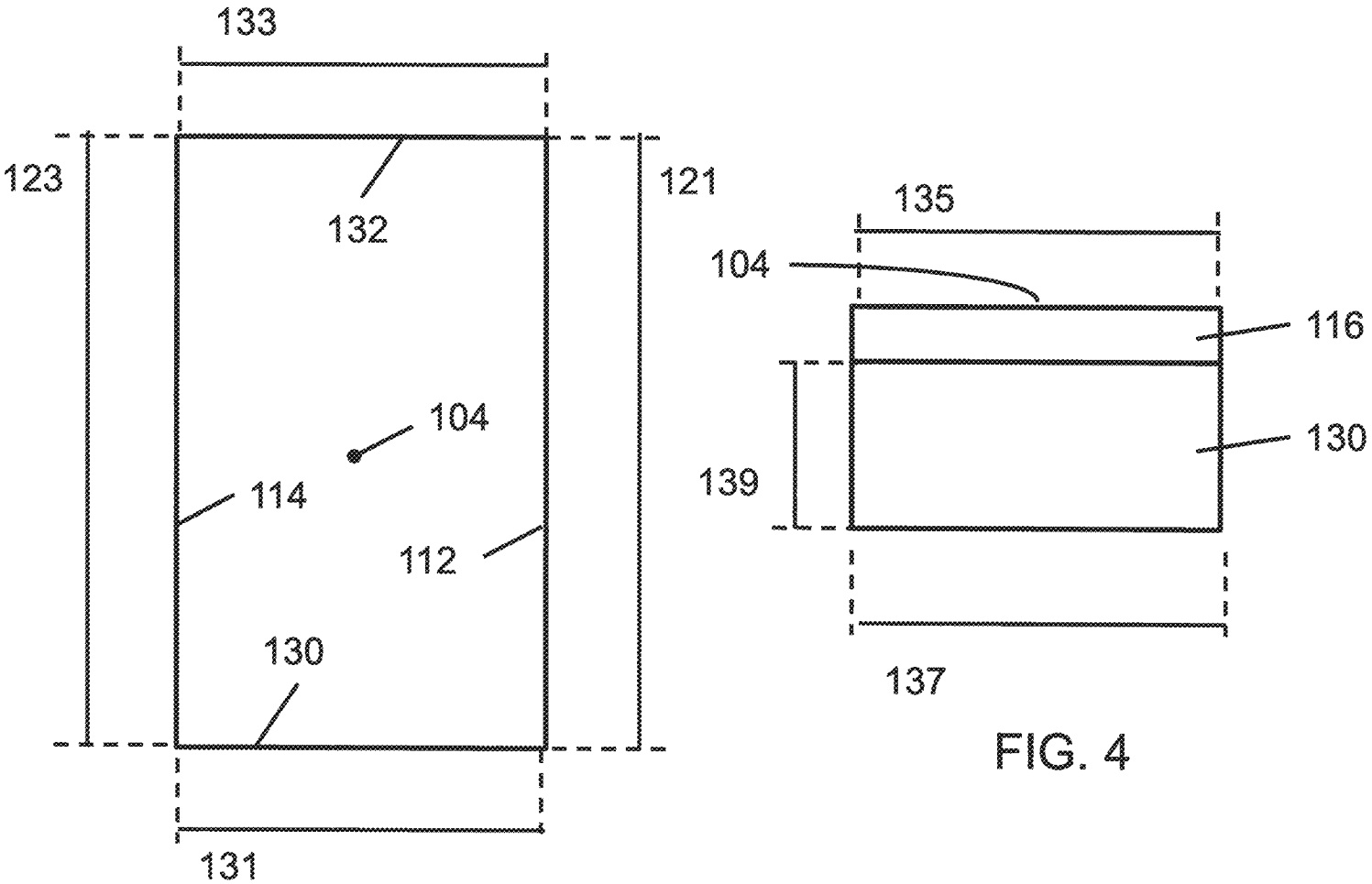
FIG. 3 is a plan (top) view of the wrist worn crayon holder of FIG. 1.
FIG. 4 is a side view of the rigid housing of the wrist worn crayon holder of FIG.

FIGS. 1-4 are various views of a first exemplary embodiment of a wrist worn crayon holder. FIG. 1 is a front perspective view. FIG. 2 is a front view. FIG. 3 is a top view of the rigid housing. FIG. 4 is a side view of the rigid housing (no wings).

Referring first to FIG. 1 and FIG. 2, the wrist worn crayon holder 100 is comprised of a rigid housing unit 110 and two wings 150/160. The rigid housing 110 has a front wall 112 and a back wall 114 on an opposite end of the housing. The rigid housing also has a top wall 116 and a bottom wall 118, and two side walls 130/132 on opposite sides thereof. A plurality of slots 140 are enclosed within the rigid housing. Put another way, each slot 140 is located within the housing formed by the front wall 112, back wall 114, top wall 116, bottom wall 118, and two side walls 130/132. Each slot extends completely through the housing from the front wall 112 to the back wall 114.

As seen in FIG. 2, the rigid housing is curved to conform to the arm of the user. From the front, the top edge 111 and the bottom edge 113 of the front wall are curved. Thus, the top wall 116 and bottom wall 118 have a curved shape, though presenting flat surfaces. The middle of the top wall 116 is indicated with reference numeral 104.

Also visible in FIG. 2 are a plurality of slots 140. Each slot is cylindrical, and configured to engage a writing utensil such as a crayon. As illustrated here, there are seven slots, though the number may be varied as desired. Again, each slot extends completely through the housing from the front wall 112 to the back wall 114. It is contemplated that the slots have a diameter that is suited to hold the writing utensil snugly. Also visible in FIG. 1 and FIG. 2 are ridges 144, which provide increased grip on the writing utensil to reduce/prevent slippage out of the slot. These are essentially raised lines, which can be made out of the same material as the rigid housing or are made out of a grippable (i.e. tacky) material that is inserted into each slot. These ridges extend the entire length of the slot.

Each slot 140 has the same diameter, which can be from about 8 mm to about 12 mm. The slots are approximately the same size as that of a crayon so as to allow the crayon to tightly fit within the structure. The perimeter of the slots in the rigid housing structure are circular, and are not triangular, rectangular, trapezoidal, or any other similar polygonal shape.

It is noted that as depicted here, there are internal side walls 142 between each slot 140. In other embodiments, it is particularly contemplated that such internal side walls 142 are not present, or put another way, each slot is defined by arcs in the top wall 116 and the bottom wall 118 of the housing only.

FIG. 3 shows a top view of the rigid housing. As seen here, the rigid housing has a rectangular shape. The front wall 112 has a width 121 that is substantially equal to the width 123 of the back wall 114. Similarly, the first side wall 130 has a length 131 that is substantially equal to the length 133 of the second side wall. Also indicated here is the middle point 104 of the holder. It is noted that the top wall can also include additional information or labeling. This provides an area for very noticeable and applicable branding.

FIG. 4 is a side view of the rigid housing, showing the first side wall 130. The first side wall is substantially rectangular. A top length 135 of the side wall is substantially equal to a bottom length 137 of the side wall. The side wall has a height 139. As seen in FIG. 1, the side wall can include additional information or labeling. The middle 104 of the top wall 116 is also visible from the side, indicating the curvature of the top wall.

Referring to both FIG. 3 and FIG. 4, the length 131 of the crayon holder is usually less than the length of a crayon, i.e. about 3.5 inches or less. It is generally contemplated that the width 121 of the housing is greater than the length 131, which is greater than the height 139 of the housing.

Returning now to FIG. 2, two wings 150/160 extend from the bottom wall 118 of the rigid housing. Each wing has a proximal end 152 and a distal end 154. Each wing is curved towards the center of the holder, such that the distal ends 154 are near each other, but do not touch. Between the proximal end 152 and the distal end 154 of each wing is a flexible bearing 156. This bearing is essentially a thinner part of the wing, extending lengthwise along the holder. Thus, surfaces 157/158 are also exposed as part of each wing near the bearing 156. Ridges may be present at the distal end 154, to provide better grip along the user's arm. Reference numeral 102 refers to the elliptical open center space in which the user's arm/wrist is located.

The rigid housing and the wings are made of a plastic or a similar rigid material. It is contemplated that the rigid housing is solid, or may have some hollow internal structures. However, no chains or other ropes are present for connecting the housing to the writing utensil. Similarly, no lid is present for accessing other internal points in the rigid housing. The housing structure is rigid, and generally does not flex, and so should not be made of a flexible material such as cloth or stretch fabric.

Figure 5:
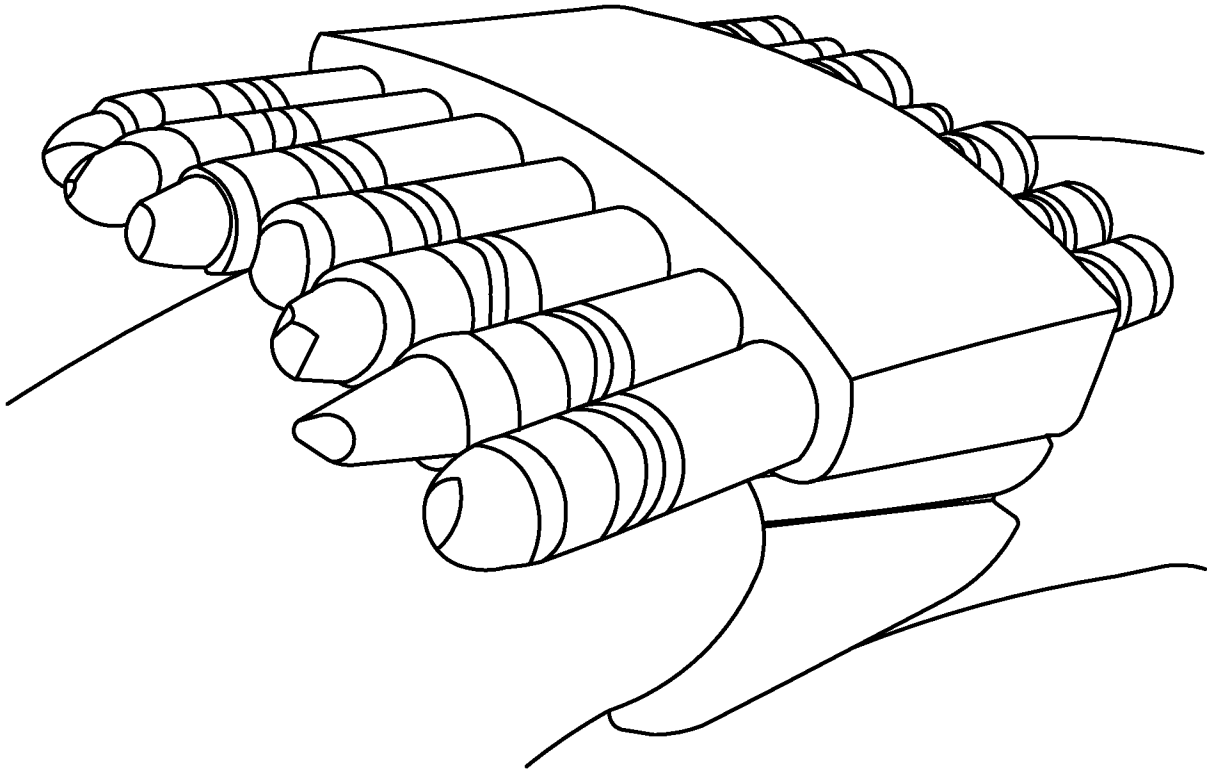
FIG. 5, is a photograph of a prototype of the wrist worn crayon holder, with crayons inserted into the slots, and the curved wings surrounding the arm of the user.

FIG. 5 is a picture of a prototype device of the present disclosure holding seven crayons and worn on the arm of a user.

The present disclosure has been described with reference to exemplary embodiments. Obviously, modifications and alterations will occur to others upon reading and understanding the preceding detailed description. It is intended that the present disclosure be construed as including all such modifications and alterations insofar as they come within the scope of the appended claims or the equivalents thereof.

The invention claimed is:

1. A device for holding writing instruments, comprising:

a rigid housing enclosing a plurality of slots; and two curved wings extending from a bottom of the rigid housing that surround a wrist to hold the device in place;

wherein the two curved wings never contact each other at their distal ends;

wherein each curved wing has: (i) a proximal end adjoining a bottom wall of the rigid housing, (ii) a distal end, and (iii) a flexible bearing configured to connect the proximal end and the distal end; and wherein each flexible bearing is configured to connect the proximal end and the distal end such that the distal end has an exposed upper surface, and the proximal end has an exposed lower surface.

2. The device of claim 1, wherein the rigid housing is curved to conform to an arm of a user.

3. The device of claim 1, wherein the slots of the plurality of slots are cylindrical and are all of substantially the same length.

4. The device of claim 1, having a total of seven slots.

5. The device of claim 1, wherein a top length of the rigid housing is substantially the same as a bottom length of the rigid housing.

6. The device of claim 1, wherein the device does not include a chain; and wherein the rigid housing has no lid.

7. The device of claim 1, having a length between a front wall and a back wall of less than 3.5 inches.

8. The device of claim 1, wherein the plurality of slots are defined by a top wall and a bottom wall of the rigid housing.

9. The device of claim 1, wherein each slot has a diameter of about 8 mm to about 12 mm.

10. The device of claim 1, wherein each slot has ridges extending the entire length of the slot.

11. The device of claim 1, wherein each slot is defined by an arc in the top wall and an arc in the bottom wall.

12. A device for holding writing instruments, comprising:

a rigid housing having a front wall and a back wall, a top wall, a bottom wall, and two side walls, and a plurality of enclosed slots extending completely through the housing from the front wall to the back wall, wherein internal side walls are located between each slot; and two curved wings extending from the bottom wall of the rigid housing that curve towards each other for surrounding an arm of a user;

wherein each curved wing has: (i) a proximal end adjoining a bottom wall of the rigid housing, (ii) a distal end, and (iii) a flexible bearing configured to connect the proximal end and the distal end; and wherein the two curved wings never contact each other at their distal ends.

13. The device of claim 12, wherein the rigid housing is curved to conform to the arm of a user.

14. The device of claim 12, wherein the two side walls have a rectangular shape.

15. The device of claim 12, wherein the enclosed slots are cylindrical and are all of substantially the same length.

16. The device of claim 12, having a total of seven slots.

17. The device of claim 12, wherein a top length of the rigid housing is substantially the same as a bottom length of the rigid housing.

18. The device of claim 12, wherein the device does not include a chain; and wherein the rigid housing has no lid.

19. The device of claim 12, wherein the plurality of slots are defined by the top wall and the bottom wall of the rigid housing.

* * * * *